United States Patent [19]

Ueda

[11] 4,300,283

[45] Nov. 17, 1981

[54] APPARATUS FOR MANUFACTURING SLIDE FASTENERS

[75] Inventor: Minoru Ueda, Kurobe, Japan

[73] Assignee: Yoshida Kogyo K.K., Tokyo, Japan

[21] Appl. No.: 105,899

[22] Filed: Dec. 21, 1979

[30] Foreign Application Priority Data

Dec. 29, 1978 [JP] Japan ..... 53-162847

[51] Int. Cl.[3] ..... B23P 19/04

[52] U.S. Cl. ..... 29/766

[58] Field of Search ..... 29/33.2, 408, 409, 766, 29/767, 768

[56] References Cited

U.S. PATENT DOCUMENTS

| | | | |
|---|---|---|---|
| 2,219,165 | 10/1940 | Nedal | 29/768 X |
| 3,340,594 | 9/1967 | Frohlich et al. | 29/408 |
| 3,353,256 | 11/1967 | Frohlich et al. | 29/768 X |
| 3,445,912 | 5/1969 | Perlman | 29/767 X |
| 3,504,418 | 4/1970 | Perlman | 29/767 X |
| 3,698,064 | 10/1972 | Uhrig | 29/408 |
| 3,714,698 | 2/1973 | Fukuroi | 29/768 X |
| 3,863,321 | 2/1975 | Perlman | 29/408 |
| 4,110,891 | 9/1978 | Akashi | 29/767 X |
| 4,236,292 | 12/1980 | Orr et al. | 29/408 |

*Primary Examiner*—Ervin M. Combs

*Attorney, Agent, or Firm*—Hill, Van Santen, Steadman, Chiara & Simpson

[57] ABSTRACT

A pair of continuous slide fastener stringers is longitudinally fed by longitudinally reciprocable grip means and driving roller means that is selectively actuatable. As the slide fastener stringers are advanced, one of the stringers is threaded through a slider held fixedly in its path of travel. The slide fastener stringers are cut off transversely across element-free gaps, and then the severed stringer pieces are moved forwardly until their leading end portions are positioned in a molding device, which molds a separable end stop on the leading end portions. The driving roller means is continuously driven to advance the slide fastener stringers until element-free gaps arrive at the cutter means, whereupon the driving roller means is de-energized.

6 Claims, 13 Drawing Figures

FIG. 8
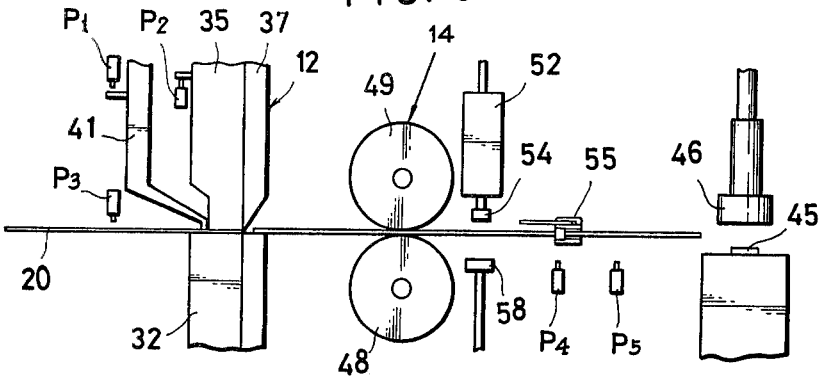
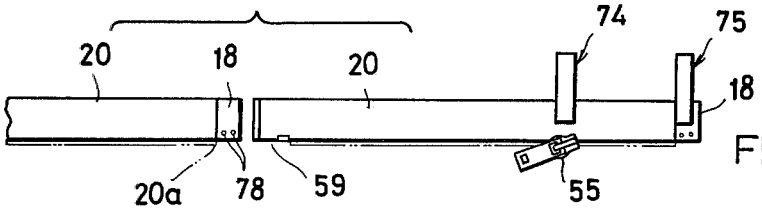
FIG. 8a
FIG. 9
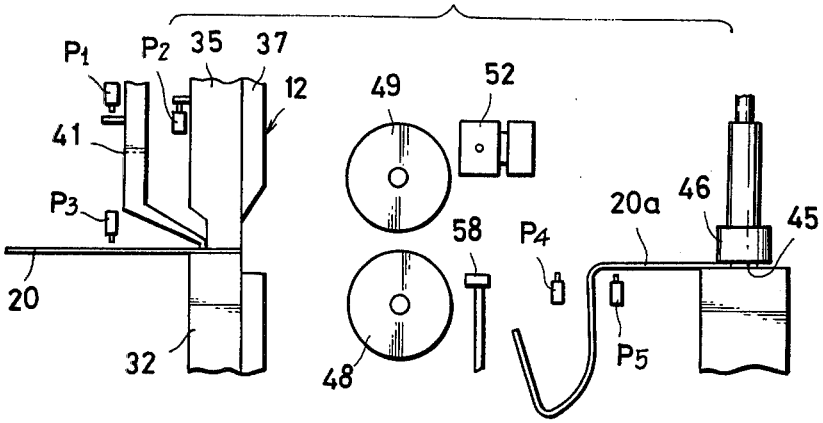
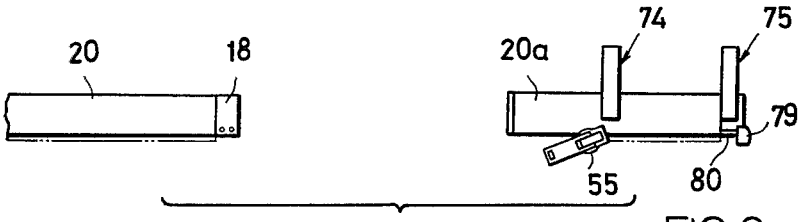
FIG. 9a

FIG. 6
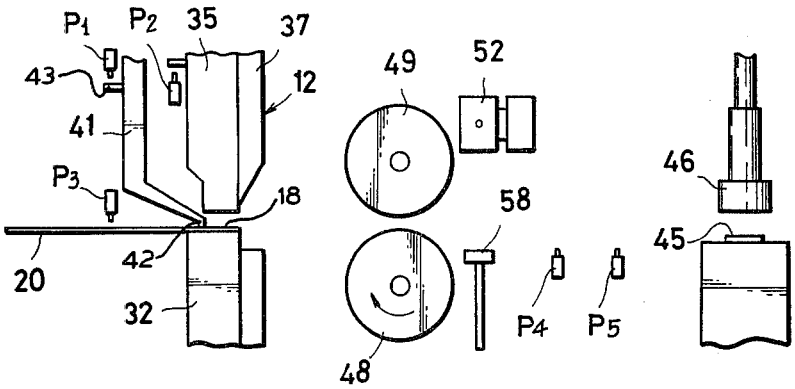
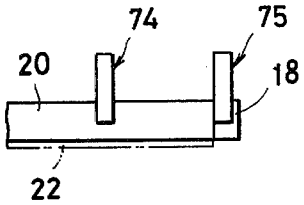
FIG. 6a
FIG. 7
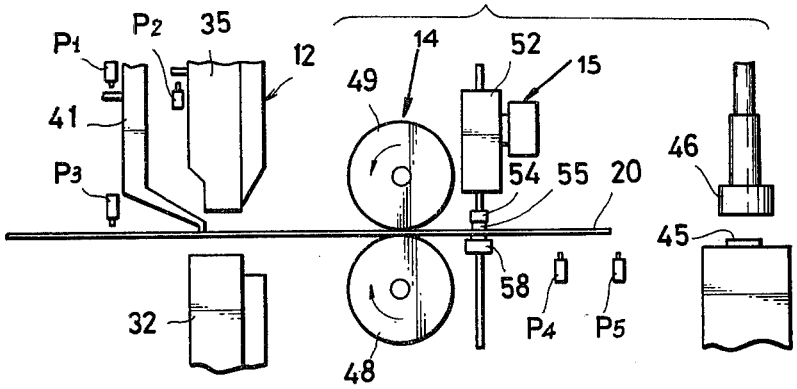
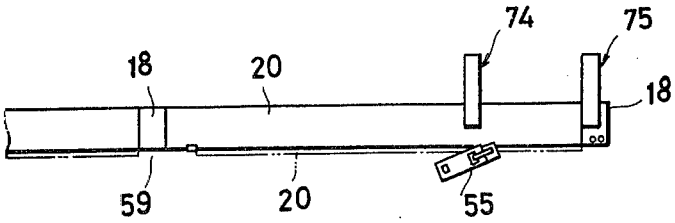
FIG. 7a

APPARATUS FOR MANUFACTURING SLIDE FASTENERS

BACKGROUND OF THE INVENTION

Field of the Invention

The present invention relates to an apparatus for manufacturing slide fasteners.

SUMMARY OF THE INVENTION

A pair of continuous slide fastener stringers are fed longitudinally along a path by a pair of longitudinally reciprocable grippers and a pair of roller means. A slider supported on a retractable slider applicator is positioned in said path, and is assembled onto one of the slide fastener stringers being advanced by the grippers and roller means. The slide fastener stringers are then stopped when one of paired element-free portions thereof arrives at a cutter, and are severed transversely across said one element-free portion, which is behind the slider that has been mounted. A separable end stop including a pin and a receptive box is formed, by a molding device, on the slide fastener stringers at the leading end thereof in advance of the slider. Instead of such severance after the advancing movement of the slide fastener stringers has been arrested, the slide fastener stringers may first be provided with a separable end stop at their leading end in advance of the slider. The slide fastener stringers are then continuously advanced until one element-free portion thereof reaches the cutter, and are stopped upon arrival at the cutter, after which they are cut off at said one element-free portion thereof behind the slider. The grippers are reciprocably movable substantially between the cutter and the mold, and the roller means is disposed between the cutter and the mold.

An object of the present invention is to provide an apparatus for manufacturing slide fastener stringers through successive processing steps such as slider attachment; separable end stop formation, and stringer severance.

Another object of the present invention is to provide an apparatus for manufacturing slide fastener stringers of varied length.

Many other advantages, features and additional objects of the present invention will become manifest to those versed in the art upon making reference to the detailed description and the accompanying drawings in which a preferred embodiment incorporating the principles of the present invention is shown by way of illustrative example.

BRIEF DESCRIPTION OF THE DRAWINGS

FIGS. 6 through 9 are sequential elevational diagrams showing parts' positions for a cycle of processing steps according to the present invention, with grip assemblies 74, 75 omitted; and FIGS. 6*a* through 9*a* are supplemental diagrams showing the stringers 20 in plan view with the grip assemblies 74,75 added, each view being coordinated in position with FIGS. 6 through 9 respectively.

DETAILED DESCRIPTION

Figure 1:
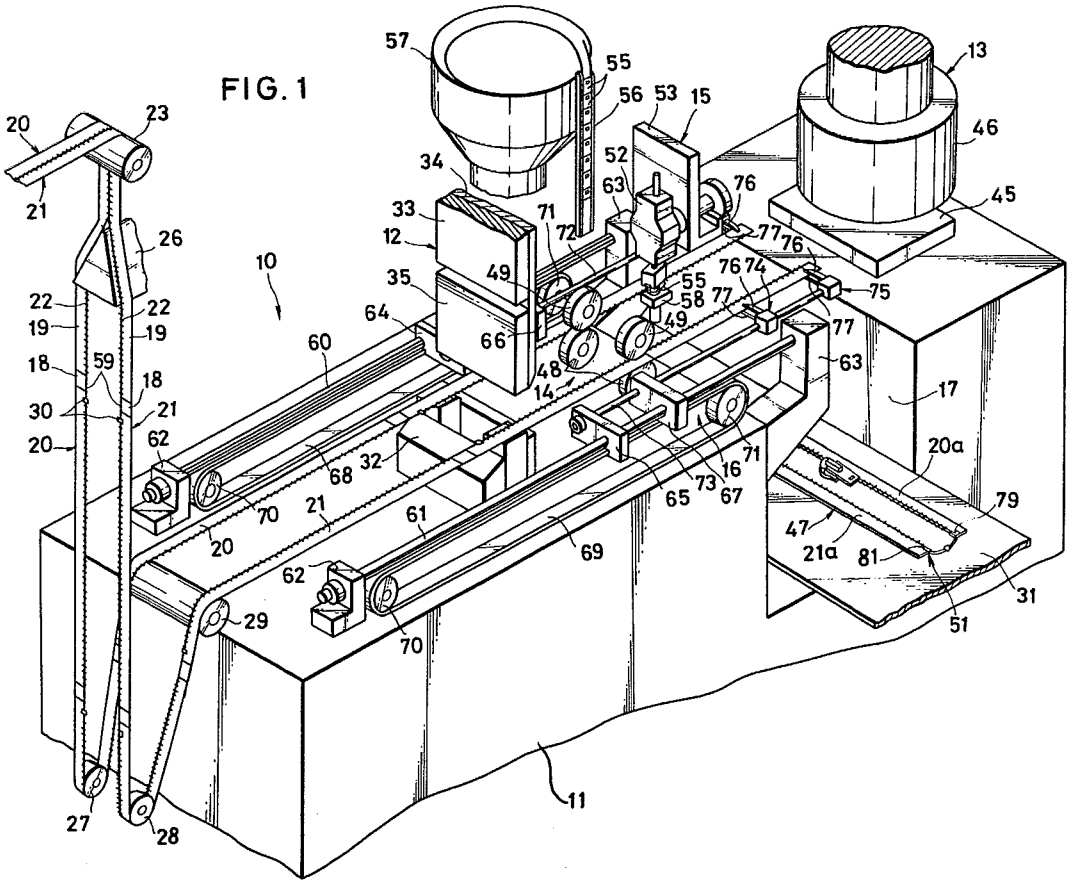
FIG. 1 is a schematic isometric view of an apparatus according to the present invention.
Figure 2:
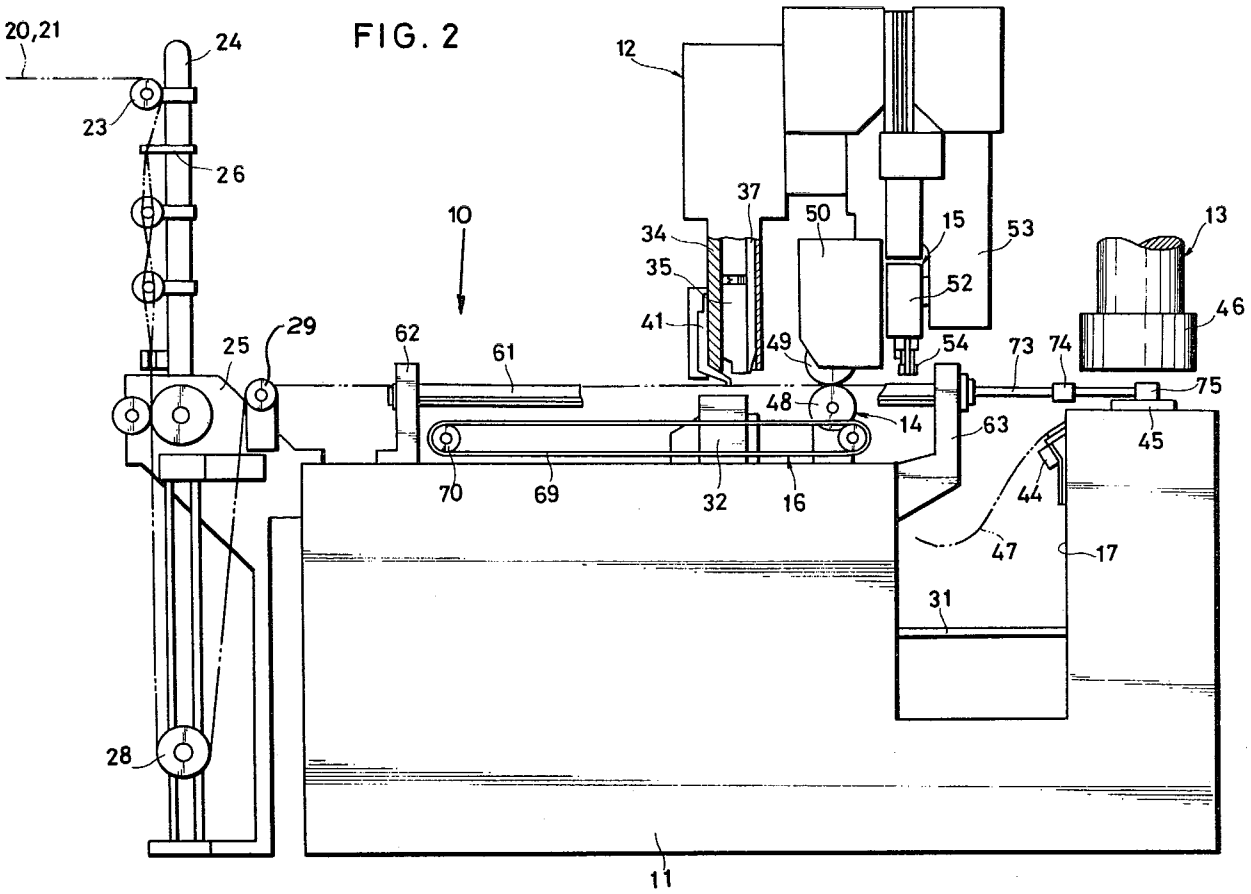
FIG. 2 is a side elevational view of the apparatus.
Figure 3:
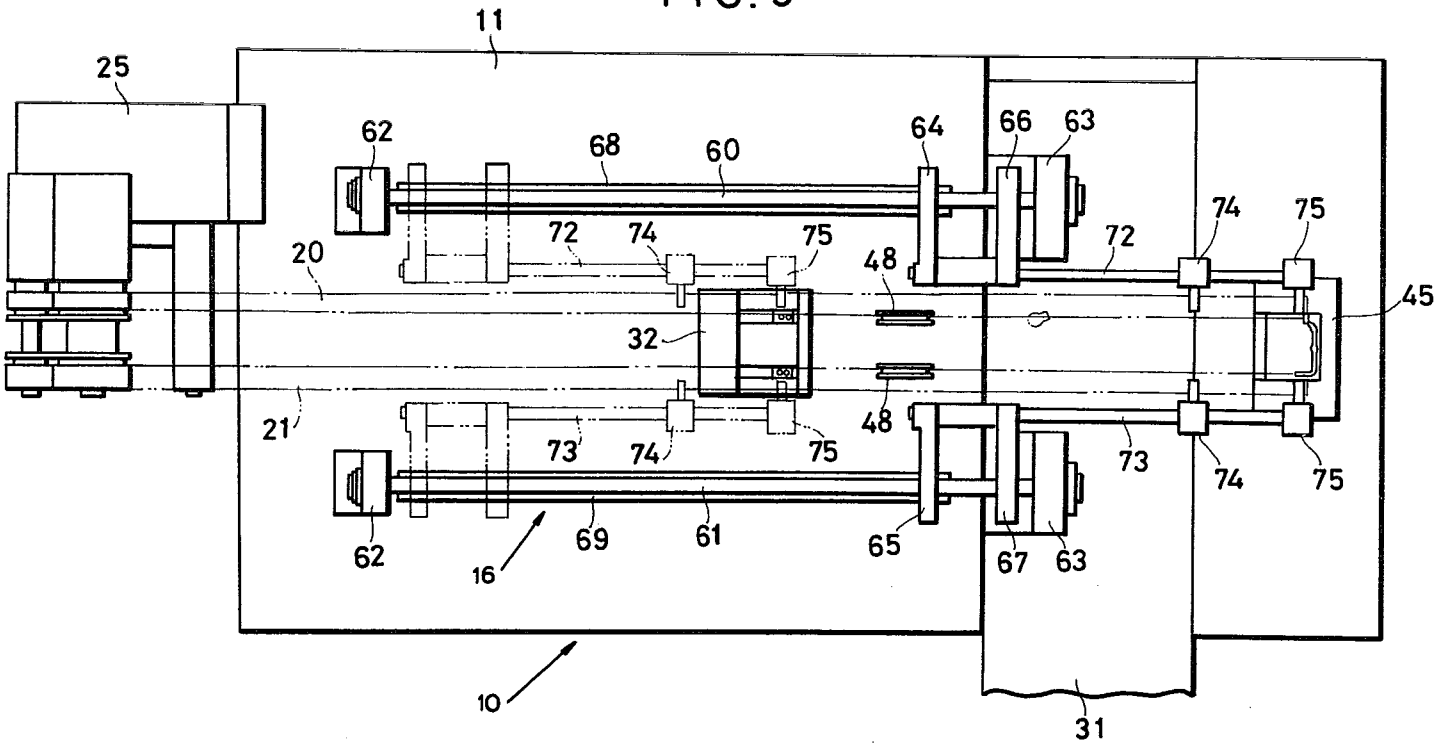
FIG. 3 is a plan view of the apparatus, with parts being omitted for clarity.

The principles of the present invention are particularly useful when embodied in an apparatus such as shown in FIGS. 1 through 3, generally indicated by the numeral 10.

The apparatus 10 generally comprises an elongated base 11, a combined cutter, presser and punch 12, a molding device 13, a driving roller assembly 14, a slider applicator 15, and a gripping and feeding device 16, the slider applicator 15 and the driving roller assembly 14 being located between the combined cutter, presser and punch 12 and the molding device 13. The base 11 has a transverse slot 17 adjacent to the molding device 13, and a discharge table 31 disposed in the slot 17.

A pair of continuous slide fastener stringers 20,21 are interengaged initially, and each includes a row of coupling elements 22 mounted on and along a longitudinal edge of a stringer tape 19. Each slide fastener stringer 20,21 also has a plurality of longitudinally spaced element-free gaps 59, a plurality of reinforcing films 18 of synthetic resin applied to the stringer tape 19 at the element-free gaps 59, and a plurality of top end stops 30 attached to the tape 19 adjacent to the films 18. The interengaged slide fastener stringers 20,21 are supplied from a bobbin (not shown), and pass around a roller 23 rotatably mounted on a post 24 (FIG. 2) secured to a bracket 25 mounted on the base 11. The stringers 20,21 are then separated from each other by a separator or splitter 26 on the post 24, and are tensioned by a pair of vertically movable tension rollers 27,28, respectively, after which the stringers 20,21 are fed around a roller 29 rotatably mounted on the base 11 onto the base 11 along a longitudinal path thereon.

Figure 4:
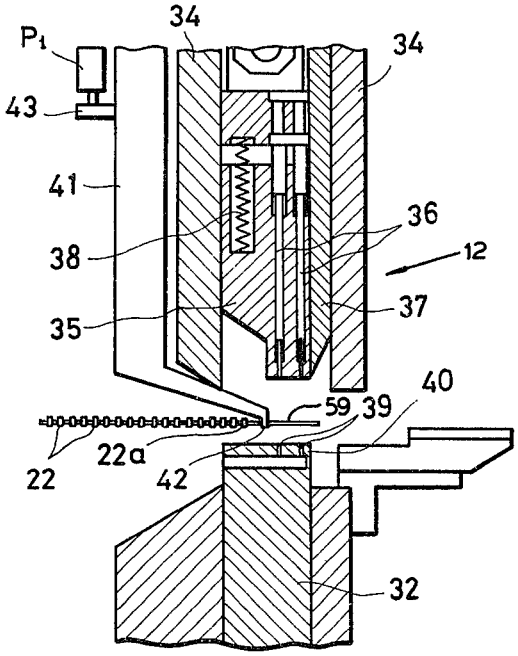
FIG. 4 is an enlarged cross-sectional view of a combined cutter, presser and punch.
Figure 5:
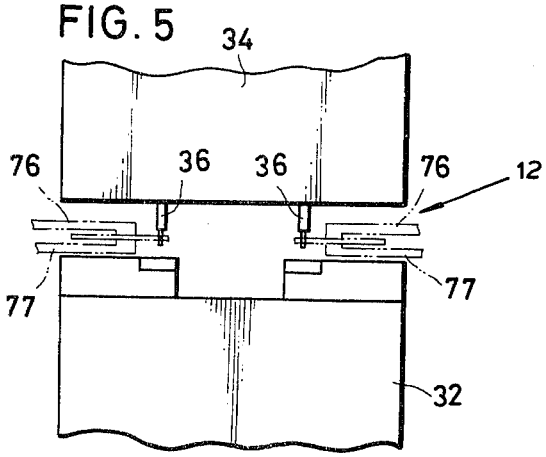
FIG. 5 is a front elevational view of the combined cutter, presser and punch.

As shown in FIGS. 4 and 5, the combined cutter, presser and punch 12 comprises a lower member or die 32 fixed to the base 11, a stationary guide frame 34, a presser 35 movable up and down in the guide frame 34, two pairs of punches 36,36 movable vertically through the presser 35, and a cutter blade 37 movable vertically in the guide frame 34. The presser 35 is resiliently supported on a drive member (not shown) through a spring 38. The lower die 32 has two pairs of punch holes 39,39 held in vertical registry with the punches 36,36, and a cutter edge 40 with which the cutter blade 37 coacts for severing the stringer tapes 19,19. A pivotable feeler 41 has at its distal end a nib 42 disposed downwardly of the presser 35 and a switch actuating bar 43 engageable with a detector switch $P_1$ described below.

The molding device 13 of FIG. 2 includes a lower mold 45 mounted on the base 11, an upper mold 46 vertically movable toward and away from the lower mold 45, and an ejector 44 located adjacent to the lower mold 45 for ejecting a slide fastener 47 formed with a separable end stop 51, not finished (FIG. 1), onto the discharge table 31. The upper mold 46, upon engagement with the lower mold 45, molds a separable end stop 51 of synthetic resin on the leading ends of the slide fastener stringers 20,21 by injection molding.

In FIG. 1, the driving roller assembly 14 includes two pairs of drive and pinch rollers 48,49. Each drive roller 48 is rotatively driven by a motor (not shown) housed in the base 11, and each print roller 49 is vertically movable by an actuator mechanism 50 (FIG. 2) toward and away from the drive roller 48. The slide fastener stringers 20,21 are advanced by the respective two pairs of drive and pinch rollers 48,49 which are held together.

As illustrated in FIG. 2, the slider applicator 15 comprises a rocker housing 52 supported on a support frame 53 for angular movement between horizontal and vertical positions, a slider holder 54 mounted on the rocker housing 52 for receiving, in its horizontal position, a slider 55 (FIG. 1) from a vertical chute 56 extending downwardly from a slider feeder 57 and for holding the slider 55 during angular movement of the rocker housing 52, and a fixed slider holder 58 that cooperates with the slider holder 54 when the rocker housing 52 is in its vertical position, for supporting the slider 55 in the longitudinal path of one of the slide fastener stringers 20, so as to be ready for attachment thereto.

The gripping and feeding device 16 shown in FIGS. 1 and 3 includes a pair of parallel rails 60,61 extending longitudinally of the base 11 and each supported by a pair of brackets 62,63, and a pair of slides 64,65 slidably mounted on the rails 60,61, respectively, and connected to a pair of longitudinally reciprocable endless belts 68,69 each stretching around a pair of drive rollers 70,71 drivably mounted on the base 11. A pair of longitudinal rods 72,73 is fixed to the slides 64,65, respectively, there being a pair of auxiliary slides 66,67 slidable along the rails 60,61 and supporting the rods 72,73, respectively. A pair of longitudinally spaced grip assemblies 74,75 is supported on each of the rods 72,73. Each of the grip assemblies 74,75 comprises a pair of grip arms 76,77 movable toward each other for gripping one of the stringer tapes 19 therebetween.

In addition to the detector switch $P_1$, other detector switches $P_2$, $P_3$, $P_4$ and $P_5$ (FIGS. 6 through 9) are provided in the apparatus 10 for controlling the combined cutter, presser and punch 12, the molding device 13, the driver roller assembly 14, the slider applicator 15, and the gripping and feeding device 16. More specifically, (see FIG. 4) when the nib 42 of the feeler 41 drops in one of the element-free gaps 59 in one of the slide fastener stringers 20,21, the actuator bar 43 is raised into contact with the detector switch $P_1$, and then when the nib 42 is engaged and raised by a terminal coupling element 22*a* adjacent to said one element-free gap 59 on advancing movement of the slide fastener stringers 20,21, the actuator bar 43 is lowered out of contact with the detector switch $P_1$, whereupon the detector switch $P_1$ is energized to send a signal for stopping advancing movement of the slide fastener stringers 20,21. The detector switch $P_2$ is actuated to move the cutter 37 downwardly when the presser 35 and hence the punches 36 are lowered. The detector switches $P_3$, $P_4$ and $P_5$ detect various predetermined positions that the grip assemblies 74,75 take during their longitudinal advancing and retracting movement.

One cycle of operation of the apparatus 10 for producing a relatively short slide fastener is now described with reference to FIGS. 6 through 9 and 6*a* through 9*a*, in which only one of the slide fastener stringers 20 is shown for clarity.

Before being actuated, the operative parts of the apparatus 10 assume the position of FIGS. 6 and 6*a*, in which the combined cutter, presser and punch 12 is lifted, the pinch roller 49 is raised away from the drive roller 48, the rocker housing 52 of the slider applicator 15 is in the horizontal position holding a slider 55 by means of the slider holder 54, and the upper mold 46 of the molding device 13 is positioned upwardly away from the lower mold 45, with slide fastener stringers 20,21 being advanced to such a point that the reinforcing films 18 at the leading end of the slide fastener stringers 20,21 are located between the presser 35 and the die 32. At the same time, the grip assemblies 74,75 in their retracted position grip leading end portions of the slide fastener stringers 20,21.

Upon reception of a starting signal, the rocker housing 52 of the slider applicator 15 is angularly moved from its horizontal to vertical position to bring the slider 55 into the longitudinal path of the slide fastener stringer 20, whereupon the slider 55 is held in position jointly by the holders 54,58. The endless belts 68,69 are driven to advance the grip assemblies 74,75 and, simultaneously, the pinch rollers 49,49 are lowered against the drive rollers 48,48 which are then rotated, thereby enabling the stringers 20,21 to move forwardly as shown in FIGS. 7 and 7*a*.

As the stringers 20,21 progress further, the row of coupling elements 22 on the stringer 20 is threaded through the slider 55 supported by the slider applicator 15, whereupon the slider 55 is released from the rocker housing 52, which is thereafter actuated automatically to be returned to its horizontal position for receiving a next slider 55.

A projection on the grip assembly 74 hits the detector switch $P_4$, (shown aligned therewith in FIGS. 8 and 8*a*) which is actuated to cause the gripping and feeding device 16 and the driving roller assembly 14 to be driven at a lower speed. The feeler 41 thereafter detects a next terminal coupling element 22*a*, and the detector switch $P_1$ is actuated to stop the endless belts 68,69 and at the same time to stop the rotation of the drive rollers 48,48. Simultaneously, the presser 35 is moved downwardly to press the stringers 20,21 resiliently against the die 32, and the punches 36,36 are lowered to punch apertures 78,78 in the reinforcing films 18 through the stringer tapes 19. The detector switch $P_2$ is energized by the downward movement of the presser 35, and produces a signal for lowering the cutter blade 37 to sever the stringers 20,21 transversely across the films 18 at a transversely aligned pair of element-free gaps 59 as shown in FIGS. 8 and 8*a*, thereby producing pieces of stringers 20*a*, 21*a* (FIGS. 9 and 9*a*), and then for retracting the cutter blade 37 upwardly.

Upon accumulation of the signals thus far produced, the drive rollers 48 and the endless belt 68,69 are again driven forwardly to advance the severed slide fastener stringers 20*a*,21*a* at a low speed, until the leading end portions of the severed pieces of stringers 20*a*,21*a* arrive at the molding device 13, and then the grip assembly 74 actuates the detector switch $P_5$ to cause the pinch rollers 49 to be lifted and the endless belts 68,69 to be stopped. The upper mold 46 is then lowered onto the lower mold 45, and then a box member 79 with a pin 80 and a pin member 81 (FIG. 1) which jointly constitute a separable end stop 51 are molded onto the films 18 at the leading ends of the severed pieces of stringers 20*a*,21*a* (FIG. 1), respectively. Thereafter, the stringer pieces 20*a*,21*a* are thrown out onto the discharge table 31 by the ejector 44 (FIG. 2), and will be finished into a completed slide fastener by the removal of any runners from the molded part. Such runners may hold the molded parts together temporarily as shown in FIG. 1.

Since the molded synthetic resin penetrates through the apertures 78, the box member 79 and the pin member 81 are fixedly retained on the stringer tapes 19,19 against being peeled off.

The grip assemblies 74,75 then start moving rearwardly until the grip assembly 74 hits the detector switch $P_3$, which generates a signal to enable the grip assemblies 74,75 to be stopped and grip the stringers 20,21 (FIGS. 6 and 6*a*). The upper mold 46 of the molding device 13 is raised away from the lower mold 45. At this time, the operative parts of the apparatus 10 are restored to the position of FIGS. 6 and 6*a* for a next cycle of operation.

With such an arrangement, the apparatus 10 can work on slide fastener stringers having varying chain lengths between adjacent element-free gaps, thereby producing slide fasteners of different lengths.

For example, the feeler 41 can first be actuated for energizing the detector switch $P_1$ before the stringer 20 is threaded through a slider 55. After the severance of the stringers 20,21, the drive rollers 48 and the endless belts 68,69 are driven to advance the stringers 20,21 for the attachment of a slider 55. In such a mode of operation, slide fasteners of a shorter length will be manufactured.

As another example, relatively long slide fasteners can be produced by maintaining the pinch rollers 49 downwardly against the drive rollers 48 after the molding of a separable end stop 51 on the stringers 20,21 until the next element-free gap 59 is detected by the feeler 41. The stringers 20,21 are severed by the cutter blade 37 after a slider 55 is attached and a separable end stop 51 is molded.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An apparatus for manufacturing slide fastener, comprising:

(a) means for severing a pair of continuous slide fastener stringers transversely across one of longitudinally spaced, transversely aligned pairs of element-free portions;

(b) means for molding a separable end stop including a pin and a receptive box respectively on the leading ends of the slide fastener stringers;

(c) grip means reciprocable substantially between said severing and molding means for advancing the slide fastener stringers along a longitudinal path;

(d) roller means disposed in said longitudinal path between said severing and molding means for feeding the slide fastener stringers along said path; and (e) means retractably disposed between said roller and molding means for positioning a slider in said longitudinal path before arrival thereat of one of the slide fastener stringers, for enabling said one stringer to be threaded through a slider during feeding of said one stringer by said roller means.

2. An apparatus according to claim 1, said severing means comprising a fixed die, a cutter movable toward said fixed die for cooperating therewith to cut off the slide fastener stringers therebetween, and a presser disposed adjacent to said cutter and movable toward said fixed die for holding the slide fastener stringers against the fixed die during said cutting off.

3. An apparatus according to claim 1, said grip means comprising a pair of longitudinal rails extending parallel to said longitudinal path, a pair of slides slidably mounted on said rails, respectively, for movement therealong, a pair of gripper means mounted respectively on said slides for gripping the slide fastener stringers, respectively, and a pair of drive means for reciprocably driving said slides along said rails.

4. An apparatus according to claim 3, each of said drive means comprising reciprocably drivable endless belt extending along said path, and one of said slides being secured to said endless belt.

5. An apparatus according to claim 3, each of said gripper means comprising a longitudinal rod, and a pair of longitudinally spaced grip assemblies mounted on said rod and each including a pair of grip arms for jointly gripping one of the slide fastener stringers therebetween.

6. An apparatus according to claim 1, said roller means comprising a pair of drive rollers and a pair of pinch rollers movable toward and away from said drive rollers, respectively, for pressing the slide fastener stringers thereagainst.

* * * * *